US009689133B2

(12) United States Patent
Haigh

(10) Patent No.: US 9,689,133 B2
(45) Date of Patent: Jun. 27, 2017

(54) ACCESS SUPPORT FOR OFFSHORE INSTALLATIONS

(71) Applicant: Renewable Hydrocarbons Ltd, Halton, Lancaster (GB)

(72) Inventor: Peter Haigh, Halton (GB)

(73) Assignee: Renewable Hydrocarbons Ltd, Halton, Lancaster (GB)

( * ) Notice: Subject to any disclaimer, the term of this patent is extended or adjusted under 35 U.S.C. 154(b) by 0 days.

(21) Appl. No.: 14/896,966

(22) PCT Filed: Jun. 9, 2014

(86) PCT No.: PCT/GB2014/051765
§ 371 (c)(1),
(2) Date: Dec. 9, 2015

(87) PCT Pub. No.: WO2014/199130
PCT Pub. Date: Dec. 18, 2014

(65) Prior Publication Data

US 2016/0115665 A1 Apr. 28, 2016

(30) Foreign Application Priority Data

Jun. 10, 2013 (GB) ..... 1310272.8

(51) Int. Cl.
*E02B 17/08* (2006.01)
*E02B 17/00* (2006.01)
(Continued)

(52) U.S. Cl.
CPC ..... *E02B 17/08* (2013.01); *B63B 9/065* (2013.01); *B63C 15/00* (2013.01);
(Continued)

(58) Field of Classification Search
CPC ..... E02B 17/08
(Continued)

(56) References Cited

U.S. PATENT DOCUMENTS 3,435,621 A * 4/1969 Johnson ..... E02B 17/021 254/106
4,973,198 A * 11/1990 Cox ..... E02B 17/021 405/195.1
2011/0140059 A1 6/2011 Krone

FOREIGN PATENT DOCUMENTS

EP 2 463 224 A1 6/2012

OTHER PUBLICATIONS

International Search Report and Written Opinion mailed Sep. 8, 2014 in International Application No. PCT/GB2014/051765.

* cited by examiner

*Primary Examiner* — Sean Andrish
(74) *Attorney, Agent, or Firm* — Eric L. Lane; Green Patent Law

(57) ABSTRACT

A support structure (10) suitable for use as a support structure to an offshore platform (12), the support structure (10) comprising a main support strut (30) having a lower end and anchorable, in use, to the seabed (16) and an upper portion arranged, in use, to extend above sea level to a height substantially equal to, or greater than, that of the platform (12), the support strut (30) comprising a guide rail (62) extending upwardly from a level above the sea level (18) to the top of the support strut (30) for cooperating with a raising framework (90) slideably mountable to the guide rail (62), and further comprising drive means (98) cooperating between the raising framework (90) and the guide rail (62) for elevating the raising framework (90) relative to the support rail (62), the support structure (10) being characterized by: the support strut (30) and raising framework (90) each comprising tracks (70, 100) arranged to substantially align end-to-end when the raising framework (90) is elevated to the top of the support strut (30), the tracks (70, 100), when so aligned, forming a substantially continuous
(Continued)

track for laterally transferring a payload (42) from the raising framework (90) to the top of the strut (30).

20 Claims, 13 Drawing Sheets

(51) Int. Cl.
*E02B 17/02* (2006.01)
*E02B 17/04* (2006.01)
*B63B 9/06* (2006.01)
*B63C 15/00* (2006.01)

(52) U.S. Cl.
CPC ..... *E02B 17/0034* (2013.01); *E02B 17/027* (2013.01); *E02B 17/04* (2013.01); *E02B 17/0863* (2013.01); *B63B 2009/067* (2013.01); *E02B 2017/0039* (2013.01)

(58) Field of Classification Search
USPC ..... 405/195.1, 196, 198, 201, 203
See application file for complete search history.

ACCESS SUPPORT FOR OFFSHORE INSTALLATIONS

BACKGROUND

This invention relates to access support, and in particular, but without limitation, to access support suitable for use in conjunction with both existing and new offshore installations.

An offshore installation (otherwise known as a platform) can either be manned or unmanned but, in both instances, routine maintenance needs to be carried out from time to time. In order to achieve this, it is necessary to man the platform and lift equipment & supplies onto the platform and this can be accomplished, in most cases, by a crane that is already mounted on the platform. However, in the case where the platform is unmanned, crane usage is infrequent, it becomes degraded over time, due to corrosion, fatigue and exposure to the elements and obsolescence issues cause failures. As such, before any maintenance and/or repair work can take place on the platform, it is often necessary to re-commission the crane prior to work commencing.

In order to achieve this, it is therefore necessary to air-lift crewmembers onto the platform using a helicopter, which is a hazardous activity. In addition, flying a crew onto the platform is very expensive.

In situations where the crew are required to maintain and/or upgrade a normally unmanned platform, it is also necessary to provide life-support on the platform in case of an emergency. For example, if the weather and/or the conditions are such that the crew cannot be evacuated by sea or air, it is necessary for them to be able to live safely on-board the platform, even if only for a short period of time. Whilst the platform may be supported whilst the crew are on the platform by a standby support vessel and/or a lifeboat system, it is generally not possible to leave crewmembers on an otherwise unmanned platform for extended periods of time.

With the passage of time, the platform degrades further, eventually leading to a situation where the required maintenance and remedial work exceeds the capabilities of helicopter intervention.

One known solution to this problem is to lift onto the platform temporary living accommodation units, which comprises sleeping quarters, messing facilities, first aid, and office space, etc., but this requires the use of an operational crane and if the crane is not serviceable, then alternative solutions need to be found. In addition, locating these temporary living accommodation units on a producing platform can result in unacceptable risks to personnel. These risks can only be mitigated by shutting down production and this will result in a major loss of revenue. This invention aims to locate the temporary living accommodation away from any hydrocarbon production areas and can incorporate blast and fire protection, which can significantly reduce the risk to personnel.

It is known, in such circumstances, to use a so-called "jack up", which is a rig that can be floated out to the platform and located close by, whereupon legs can be extended downwardly from the jack-up until they rest on the seabed. Further jacking thereby raises the jack-up above the water level providing a temporary structure adjacent the main platform, which can be used for providing the necessary life-support services, equipment and storage space that, is needed for the operators on-board the platform. However, a jack-up is extremely expensive to use and therefore a need exists for an alternative type of support structure, in particular for an offshore platform.

It is also known to provide an accommodation support vessel (ASV) adjacent the main platform with a bridge connector, which can be anchored to the platform. However, these ASVs also involve the use of a jack-up for crane installation (albeit for a shorter period of time than if the jack-up were to be used, itself, as the support structure) and this, of course, introduces additional cost and complexity to the procedure.

A further consideration is that all of the above solutions rely on helicopter access and this significantly increases the risk to personnel when compared with marine access solutions. However, to date, these marine access solutions have been unable to provide a method of safely docking and remaining on station.

The invention therefore aims to provide a solution to one or more of the above problems and/or to provide an improved and/or alternative support structure for use when working on, or servicing, an offshore platform.

The invention may also provide a solution, which reduces the risk to personnel whilst addressing one or more of the above problems: the combination of remote temporary living accommodation and marine access may result in a major reduction in the risk to personnel and may facilitate further safety improvements.

Various aspects of the invention are set forth in the appendent claims.

SUMMARY

According to a first aspect of the invention, there is provided a support structure suitable for use as an extension structure to an offshore platform (new or existing), the extension structure comprising a main support strut having a lower end and anchorable, in use, to the seabed or platform and an upper portion arranged, in use, to extend above sea level to a height substantially equal to, or greater than, that of the platform, the support strut comprising a guide rail extending upwardly from a level above the sea level to the top of the support strut for cooperating with a framework mountable to the guide rail, and further comprising drive means cooperating between the framework and the guide rail for elevating the framework relative to the support rail.

A second aspect of the invention provides a support structure suitable for use as a support structure to an offshore platform, the support structure comprising a main support strut having a lower end and anchorable, in use, to the seabed and an upper portion arranged, in use, to extend above sea level to a height substantially equal to, or greater than, that of the platform, the support strut (30) comprising a guide rail extending upwardly from a level above the sea level to the top of the support strut for cooperating with a raising framework slideably mountable to the guide rail, and further comprising drive means cooperating between the raising framework and the guide rail for elevating the raising framework relative to the support rail, the support structure being characterised by: the support strut and raising framework each comprising tracks arranged to substantially align end-to-end when the raising framework is elevated to the top of the support strut, the tracks, when so aligned, forming a substantially continuous track for laterally transferring a payload from the raising framework to the top of the strut.

Suitably, the framework can be used to elevate items relative to, or to the top of, the support strut. Suitably, the invention provides a system whereby the support strut can be anchored to the seabed adjacent to a platform and maintained in a fixed relationship thereto, and which enables equipment to be hoisted onto the support strut after installation. Advantageously, this means that the support strut itself, in one embodiment, can be floated to the site of the platform and anchored in position separately from any associated equipment, which can later be affixed to the support strut. Such a configuration may greatly facilitate the initial installation procedure.

Thereafter, the invention enables various items of equipment to be hoisted up, and optionally, mounted to the support strut after the support strut has been installed. This conveniently provides a solution to the problem having to use a jack-up to install and/or commission the support structure prior to work commencing.

Suitably, the main support strut floats so that it can be floated and/or towed out to the platform by a barge or other support vessel. One or more flotation collars may initially be provided on the support strut to enable it to be up-ended during the installation process. By suitably locating the flotation collar relative to the support strut, the combined centre of buoyancy of the collar(s) and strut can be aligned with the centre of gravity of the strut to enable the strut to be floated in a controlled manner. When the strut is in position, the position of the flotation collar(s) can be adjusted to tilt the support strut into a vertical orientation to allow it to sink vertically to engage the seabed.

The support strut suitably comprises an anchorage at its lower end, such as a suction pile or screw pile that enables the lower end of the support strut to be positively engaged with the sea bed. Additionally or alternatively, anchorages may be provided, connected to the support strut by guy wires that serve to stabilise the attitude and/or position of the support strut.

Once in position, the support strut can be affixed permanently, temporarily or semi-permanently to the platform, for example, using a connecting frame that can be welded, bolted, riveted etc. to the platform and the support strut. Thereafter, any guy wires can be kept in position, or discarded, as required.

Suitably, the sliding framework is adapted to receive a crane, which can be mountable thereto in one embodiment, for example, on tracks. By such a configuration, it may be possible to hoist a crane to the top of the support strut using the framework and guide rail assembly such that when the support frame reaches the top of the support strut, it is then possible to transfer the crane laterally from the framework to the top of the support strut. By such a configuration, it may be possible to install the support strut in the first instance and then to offer-up a framework-mounted crane to support strut via a support vessel, such as a barge boat.

The drive means cooperating between the framework and the guide rail for elevating the framework relative to the support rail can be provided in any number of ways. In a first embodiment of the invention, the drive means comprises a pulley system, which is suitably motor-driven, which enables items of equipment to be hoisted up the support strut by pulling on a pulley cable connected at one end to the framework and at the other end to a driving motor. In alternative embodiments of the invention, the guide rail comprises a toothed section forming a rack and the drive assembly comprises a gear adapted to engage the rack of the guide rail such that the framework can be driven directly up the guide rail by the cooperation of the motor-driven drive gear cooperating with the rack of the guide rail.

Suitably, means is provided for preventing the inadvertent and/or unintentional lowering of the framework relative to the guide rail. This can be provided in any one of a number of ways including the provision of a fall-arrest device associated with a hoisting cable (in the case of a pulley hoist system), or, in a preferred embodiment, by the use of a pawl cooperating between the framework and the rack of the guide rail, which is able to ratchet freely up the guide rail, but which engages with the rack when the motor drive assembly is stopped and/or disengaged. In a yet further possible embodiment of the invention, the fall-arrest device comprises a plurality of catches located on the guide rail that sequentially engage with the framework as it is elevated and which are arranged to inhibit and/or prevent inadvertent downward movement of the framework relative to the guide rail.

BRIEF DESCRIPTION OF THE DRAWINGS

An embodiment of the invention shall now be described, by way of example only, with reference to the accompanying drawings, in which.

DETAILED DESCRIPTION

Figure 1:
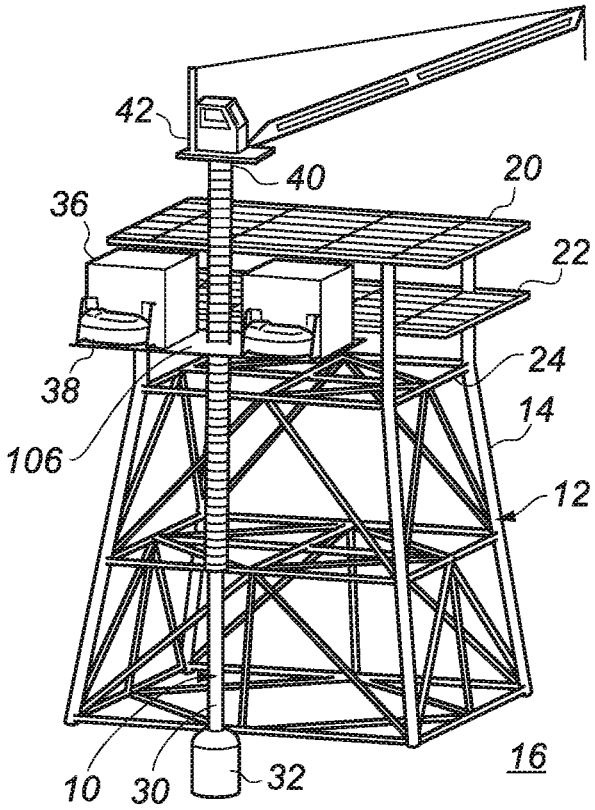
FIG. 1 is a perspective view of a support structure in accordance with the invention installed adjacent a platform.

In FIG. 1, a support structure 10 is located adjacent an offshore platform 12. The platform 12 comprises a support framework 14 anchored to the seabed 16 for supporting, above sea level 18 a weather deck 20, a cellar deck 22 and a spider deck 24. The platform usually comprises equipment, a crane and wellheads, which are not shown for clarity in the drawings.

The support structure 10 is located next to the platform 12 and comprises a main support strut 30 that is anchored to the seabed 16 using a suitable attachment, which, in the illustrated embodiment, is a suction pile 32, although other anchorages may be used depending on the type of seabed (rock, sand, silt, gravel, etc.). An upper part of the support strut 30 is connected to the platform 12 by connecting steelwork (not visible in FIG. 1). The support structure 10 additionally comprises a deck 106 upon which are located modular accommodation units 36 and lifeboats 38. The top of the support strut 30 flares outwardly to form an integrally-formed pedestal 40, which provides a base for a crane 42. As such, the support structure 10 is located beside the platform 12 and provides a crane 42 for hoisting equipment onto the deck 106 of the support structure 10 and onto a deck 20 of the platform 12, as required.

The support structure 10 is thus comprised of a number of components, these being: interface steelwork (for connecting the support structure to the platform); a main support strut and suction pile; a crane pedestal; a crane, accommodation and installation system; and a power system for independently powering the support structure, for example, a diesel generator.

Figure 2:
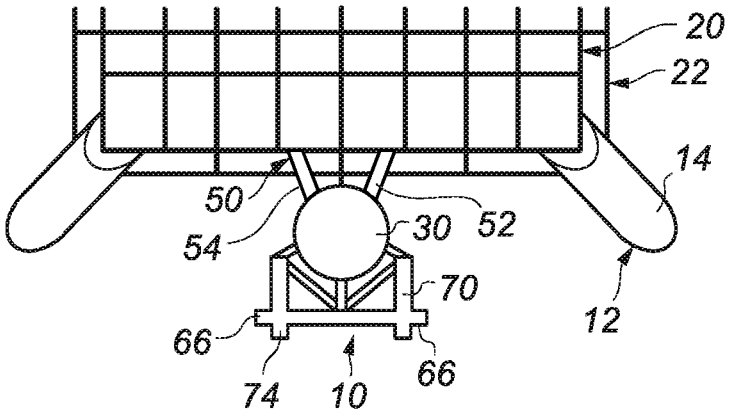
FIG. 2 is a schematic plan view of a connecting framework located between the support structure and the platform.

FIG. 2 schematically illustrates the interface steelwork 50 that connects the main support strut 30 to a platform 12 platform at the spider deck 24, cellar deck 22 and/or weather deck 20 levels: the simplest arrangement being a connection at the spider deck 24 level with access then being via the platform access system from the spider deck 24 to the cellar deck 22. However, connections at cellar deck 22 and weather deck 20 levels would provide multiple access and egress routes and align with the use of a crane 42 supported from the support strut 30. The interaction between the platform 12 and the support strut 30 also needs to be considered due to each supporting the other, however, for installations with weight, load and/or pile load constraints the support strut 30 and suction pile 32 can be sized to alleviate these constraints.

The interface steelwork 50 comprises a part-circular profile 52 that seats against, and which can be welded to the support strut 30, along with at least two splayed connectors 54 that extend between the part-circular profile 52 and the spider deck framework 24. Additional bracing may be provided to add rigidity to the connecting steelwork, where necessary.

The interface steelwork 50 fulfils four functions: as installation aid for the support strut 30 and suction pile 32; support for the crane installation system (described below); support for the support strut 30 and suction pile 32; and support for the access walkways to and from the platform.

Suitably, the interface steelwork 50 will be pre-fabricated and installed on the platform using bolted connectors, which require a minimum of preparation work on the platform 12. The interface steelwork 50 also incorporates a locating device and clamps to fix the support strut 30 before it is rotated to a vertical orientation. As such, the interface steelwork provides a pivot point and securement for the support strut 30 as it is tilted to a vertical orientation. Once the suction pile 32 is set at the correct depth, the clamps (not shown) can be closed and secured.

The support strut 30 and suction pile 32 are designed in accordance with the site-specific requirements: the main considerations being the locations of the access and egress levels; the crane requirement; platform support and environmental considerations. In addition, the support strut 30 is designed to float so that it can be towed to site, which can reduce installation costs significantly.

In situations where a crane 42 is specified, the support strut 30 and suction pile 32 design needs to be modified to accommodate both the crane installation loads and the crane operating loads.

Figure 3:
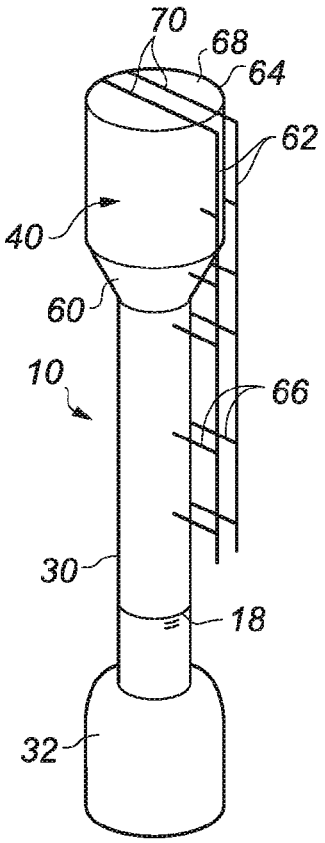
FIG. 3 is a schematic perspective view of an embodiment of a support strut.

Because most crane pedestals are typically of a larger diameter than what is required for the support strut, a pedestal is provided at the top of the support strut, as shown in FIG. 3. In FIG. 3, the support structure 10 comprises a hollow, tubular support strut 30 with a suction pile 32 at its base—the hollow tubular construction allowing it to float, when in a horizontal orientation, but submersible, when desired, for example, by partially flooding it with sea water. The support strut's 30 upper end is fitted with a crane pedestal 40, which is of a larger diameter at its upper edge than that of the support strut. A flared portion 60 is provided to transmit the loads into the support strut 30 and the overall height of the support structure 10 can be adjusted off-site by appropriately sizing the support strut and by sliding the pedestal 40 relative thereto prior to welding into position.

The support structure 10 additionally comprises a pair of guide rails 62 that extend from a point level with the upper edge 64 of the pedestal 40 to a point above sea level 18. The guide rails 62 are rigidly connected to the support strut 30, at intervals, by connectors 66, which, in practice, would comprise triangulation elements (not shown for clarity) to form a rigid connection between the two.

The upper surface 68 of the pedestal comprises a pair of parallel tracks 70 that project beyond the edge 64 of the pedestal and overlie the upper ends of the guide rails.

Figure 4:
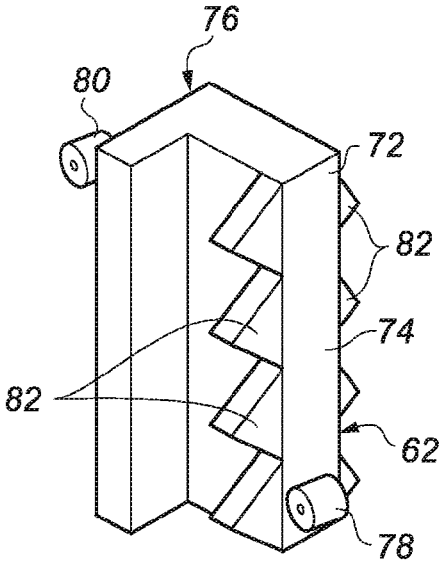
FIG. 4 is a perspective view showing the detail of the guide rails shown in FIG. 3.
Figure 5:
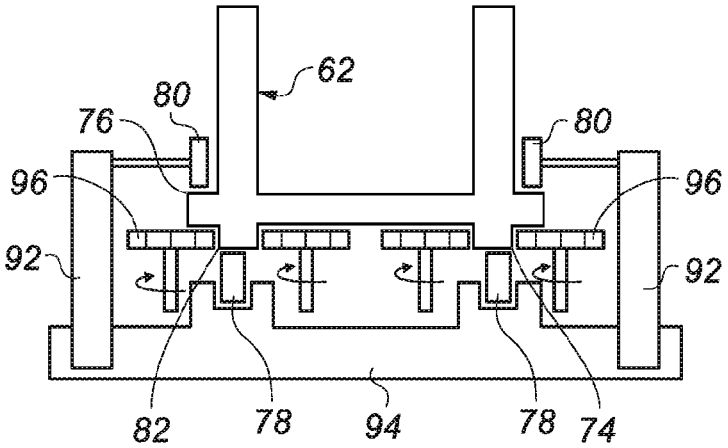
FIG. 5 is a plan view showing the detail of the guide rails and raising framework of FIG. 4.
Figure 6:
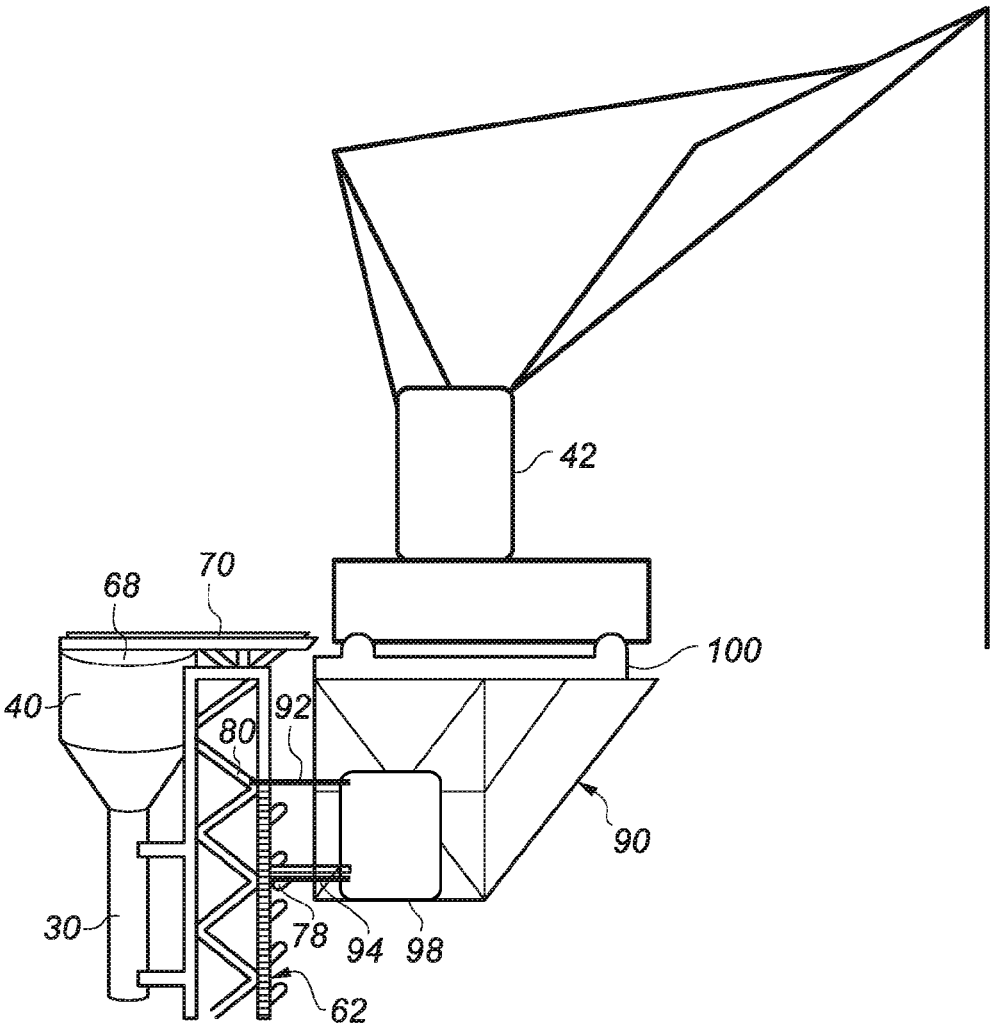
FIG. 6 is a schematic side view showing the operation of the raising framework of the support structure.

The guide rails 62 are shown in greater detail in FIGS. 4 to 6 of the drawings. In FIG. 4 it can be seen that each guide rail 62 comprises a central bar portion 72 having a smooth front surface that faces away from the support strut 30, and a smooth rear surface 76 that faces towards the support strut 30, in use. The front 74 and rear 76 surfaces provide rolling surfaces for respective, vertically spaced-apart sets of rollers 78, 80 to which a raising framework (not shown) is connected. The sides of each guide rail 62 are provided with toothed formations 82, which engage with the teeth of driving gears (not shown in FIG. 4) to enable the raising framework to be driven along the guide rails, either upwardly or downwardly, as required.

FIG. 5 is a plan view of the guide rails 62 described above. In FIG. 5, the raising framework 90 comprises a pair of arms 92 that extends behind the guide rails 62 at a relatively elevated position to support a set of rollers 80 that bear against the rear rolling surface 76 of the guide rails 62. The raising framework additionally comprises a cross bar 94 at a relatively lower position to which another set of rollers 78 are connected, which bear against front rolling surface 74 of the guide rails 62. The toothed portions 82 of the guide rails 62 project sideward from the guide rails 62 and are engaged by motor-driven gears 96 to raise or lower the raising framework 90.

In FIG. 6 it can be seen how the raising framework 90 cooperates with the guide rails 62 to enable a payload, a crane in the illustrated example, to be hoisted up the support strut 30 using an engine 98 for driving the gears 96.

As can also be seen in FIG. 6, the raising framework 90 is adapted to carry a pair of parallel tracks 100 that are arranged to align with the tracks 70 on top of the pedestal 40 of the support structure 10. By raising the raising framework 90 to the top of the guide rails 62, the respective tracks 100, 70 meet end-to-end, suitably by the provision of complementarily chamfered ends, to enable a payload to be transferred laterally (by rolling it along the tracks 100, 70) from the raising framework 90 to the top of the pedestal 40.

The installation of the support structure proceeds as shown in the sequence of FIGS. 7 to 19 of the drawings.

Figure 7:
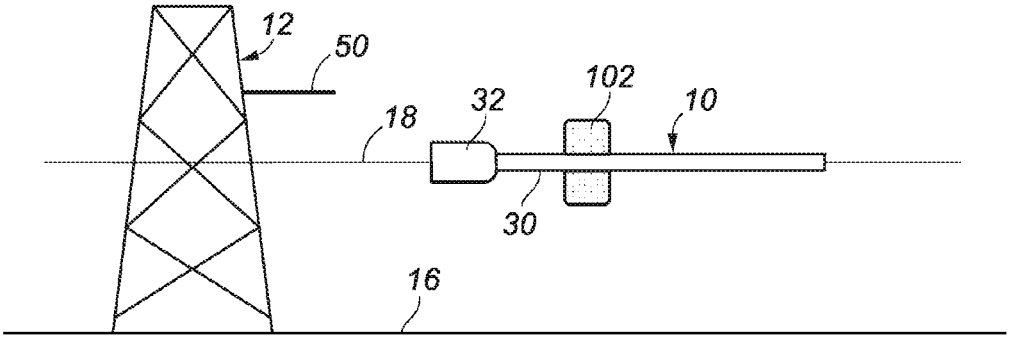
FIGS. 7 to 16 are a sequence showing the installation and assembly of the support structure.
Figure 8:
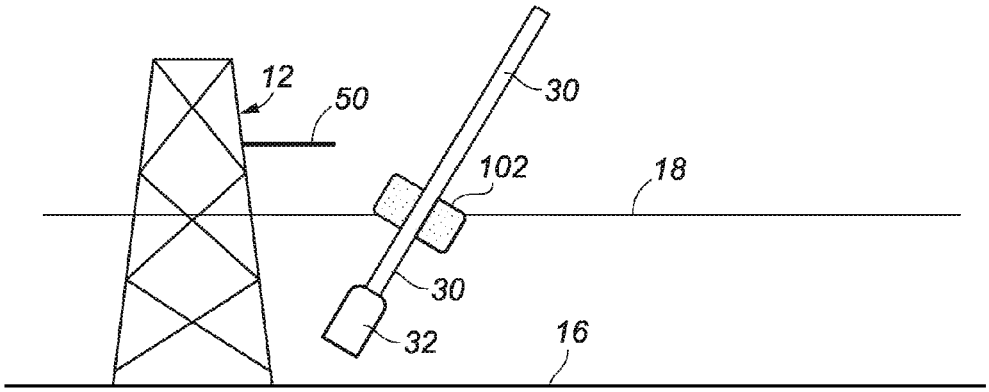
Figure 9:
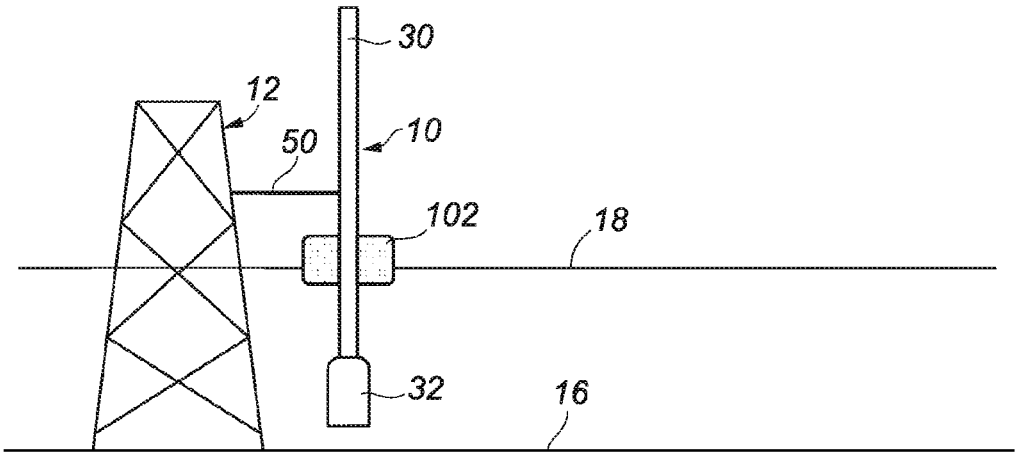
Figure 10:
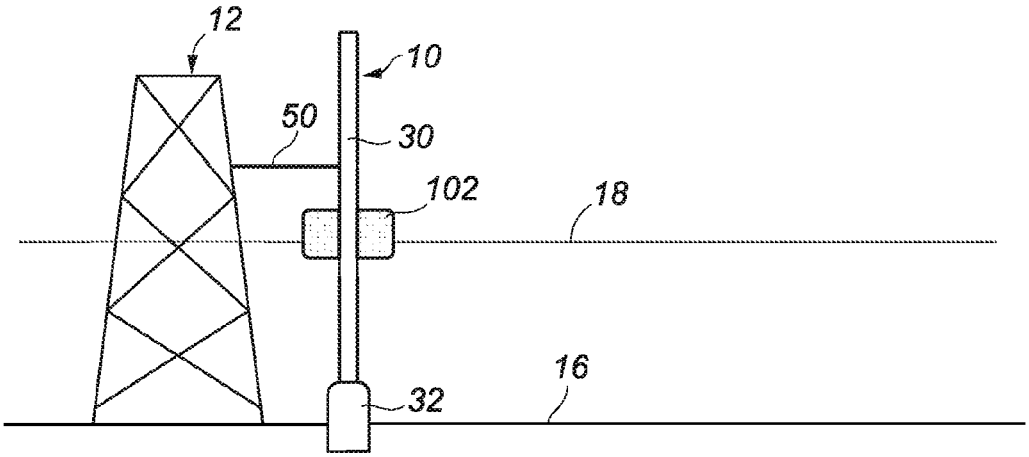
Figure 11:
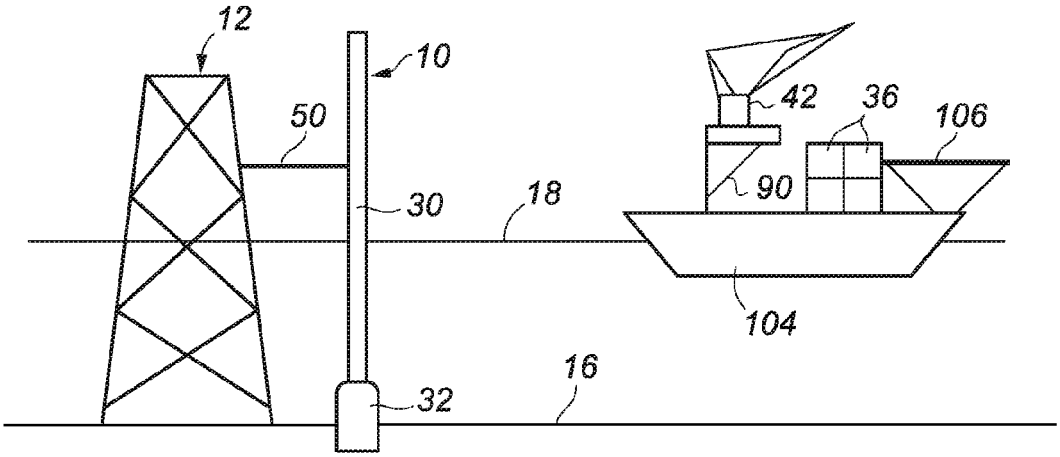

In FIG. 7, the support strut 30 and suction pile 32 are floated to the platform 12, with pre-installed connecting steelwork 50 in place, and one or more floatation collars 102 are used to maintain the strut 30 in a horizontal orientation. In FIG. 8, the support strut 30 is up-ended, for example by partially flooding it, until it reaches a vertical orientation as shown in FIG. 9. At this point, the location of the strut 30 can be adjusted freely, or the strut 30 can be located against pre-installed connection steelwork (not shown) on the platform 12. The strut 30 can then be sunk by allowing the flotation collars 102 to slide upwardly until the suction pile 32 engages the sea bed 16. The suction pile can then be evacuated (or the strut otherwise anchored to the sea bed 16) to hold it in position and the floatation collars 102 removed.

Figure 12:
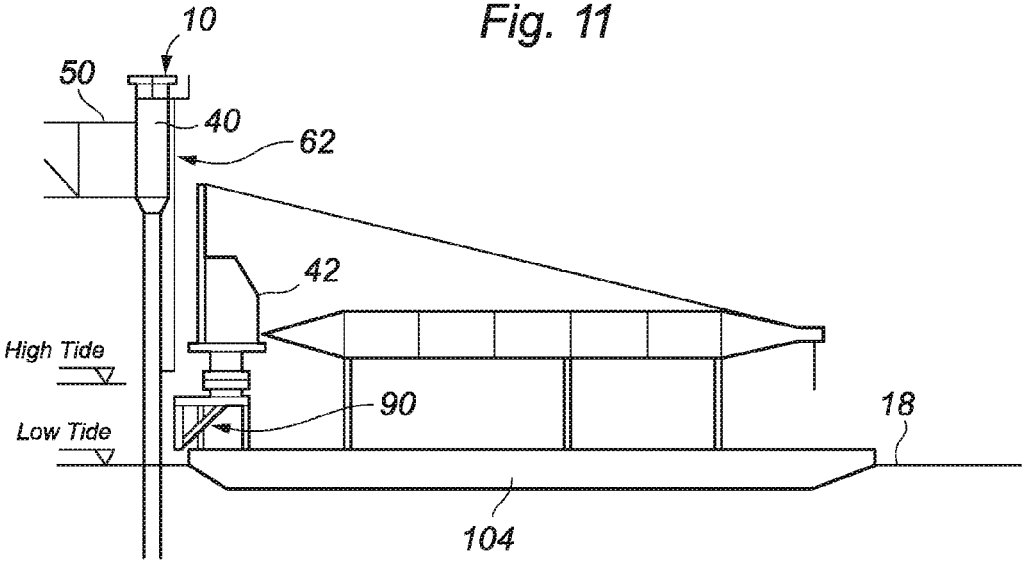
Figure 13:
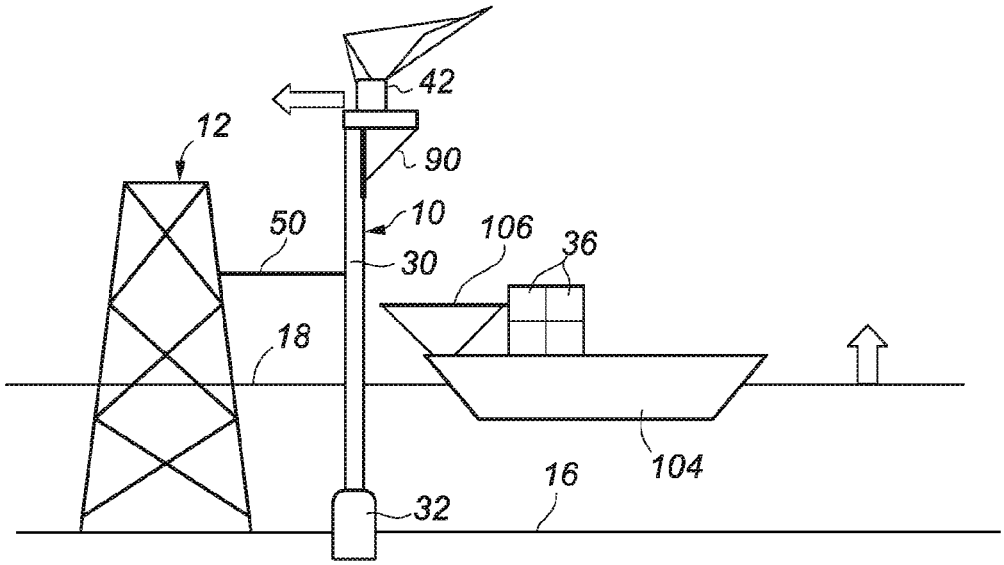

In FIG. 12, a support vessel 104 approaches the support structure 10 at low tide such that the raising framework 90 can be offered up beneath the lower ends of the guide rails (not shown for clarity). As the tide rises, as shown in FIG. 13, the raising framework 90 engages the ends of the guide rails 62 and can be driven up the support strut 30 with its first payload, in this case, a crane 42, using the drive gears previously described. When the raising framework 90 reaches the top of the support strut 30, the crane 42 can be transferred to the top of the support strut on the rails 70, 100 previously described, and locked into position.

Now that the crane 42 has been installed, it is possible to use the crane 42 to transfer other items from the support vessel 104, such as a deck 106 and to install it on the support strut 30. The deck 106 would have to be installed piecewise. Thereafter, living accommodation units 36 and the like can be hoisted, using the crane 42, onto the deck 106 of the support structure 10 to complete the installation.

Figure 14:
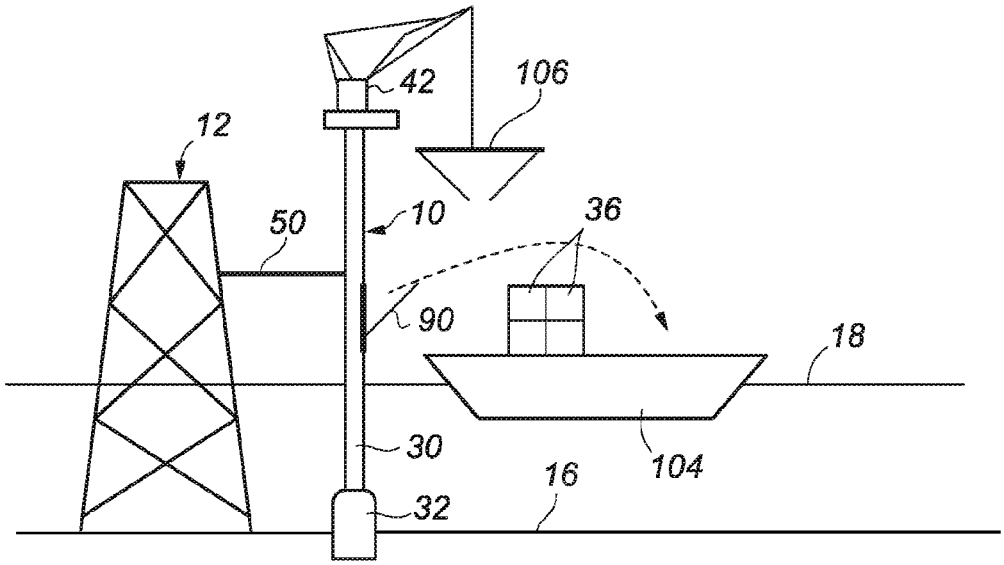
Figure 15:
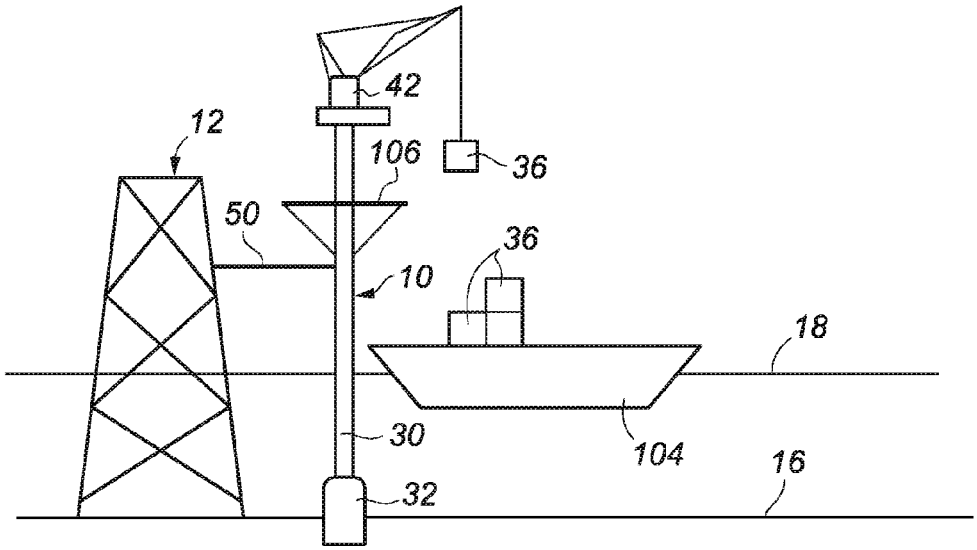
Figure 16:
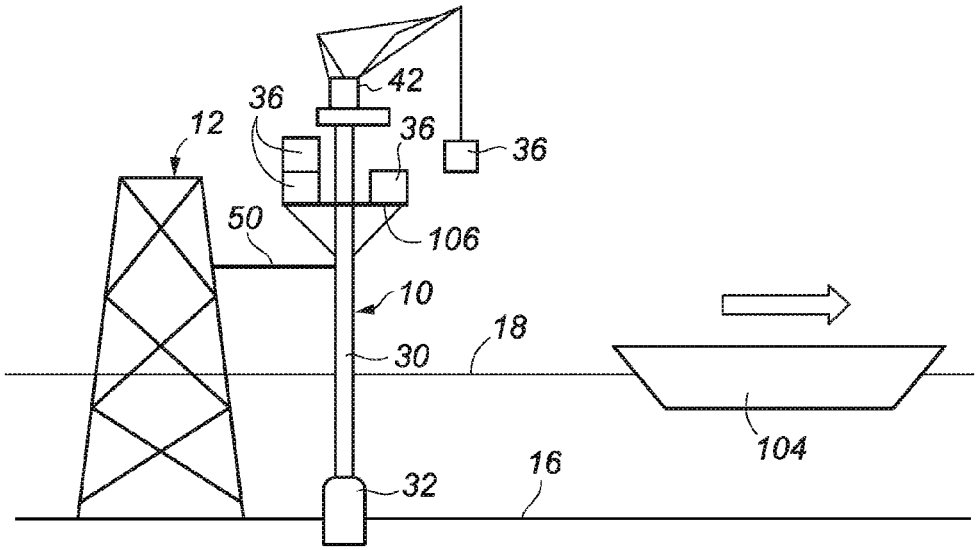
Figure 17A:
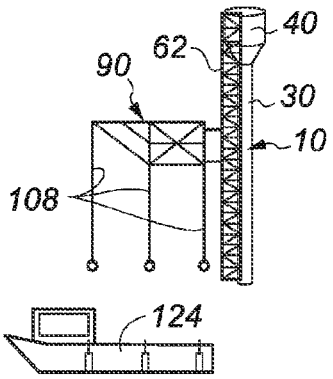
FIG. 17 is a sequence showing how the support structure of an embodiment of the invention can be used to hoist a support vessel out of the water.
Figure 17B:
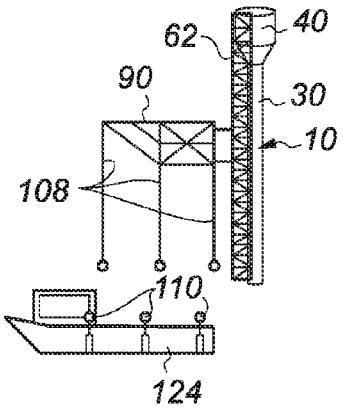
Figure 17C:
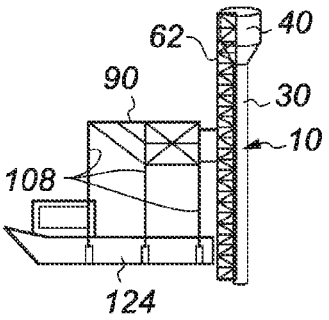

At this point, as shown in FIG. 14, the raising framework 90 can be jettisoned, or it can be left in place to act as a davit system for raising a fast intervention vessel 124 out of the water, as shown in FIG. 17. Such a configuration allows the fast intervention vessel 124 to be hoisted safely out of the water so that it no longer moves relative to the support structure 10, thus facilitating the safe transfer of crew from the vessel 124 to the support structure 10, and also providing lifeboat or life-support for the support structure 10 should that be necessary.

The fast intervention vessel 124 can be hoisted using a set of under-hull slings or by attachment of crane hooks to hard eyes on the deck of the vessel 124. Once hoisted into position relative to the raising framework, linkages can be used to free the crane for other uses. Alternatively, on a low tide, the vessel 124 can be located below the raising framework 90 and connect thereto by slings or wires, and the raising framework driven up the support strut 30 in the previously described manner to hoist the vessel 124 out of the water. Such an arrangement is shown in FIG. 17 of the drawings, whereby the vessel 124 can be connected to the raising framework 90 by a set of linkages 108 that connect to hard eyes 110 on the deck of the vessel 124.

The crane 42 can be powered by an internal combustion engine, and fuel tanks therefor can be conveniently located within the interior of the strut 30 or pedestal 40.

Figure 18:
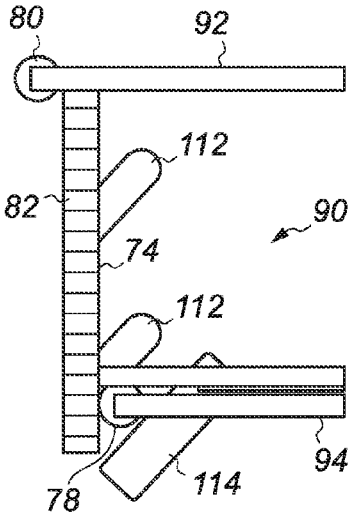
FIGS. 18 and 19 are schematic side views showing a fall-arrest arrangement for use in conjunction with the raising framework described herein.
Figure 19:
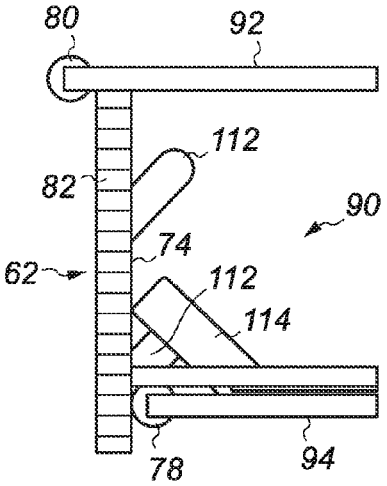

A fall-arrest device is also provided for the raising framework 90 to prevent inadvertent falls, for example, in the event of an engine 98 failure. The fall-arrest device can comprise a pawl arrangement that ratchets against the toothed racks 82 of the guide rails 62, or a supplementary set of catches can be provided, as shown in FIGS. 18 and 19. In FIG. 18, it can be seen that the guide rails 62 are provided with a series of catches 112 and that the raising framework 90 comprises a pivoting loop 114 that successively hooks over the catches 112 as the raising framework 90 is raised. Lowering of the frame 90 can be effected by dis-engaging the loop. However, in the event of an engine failure, the raising framework 90 drops until the loop 114 engages one of the catches 112 thereby preventing further descent of the raising framework 90.

Figure 20:
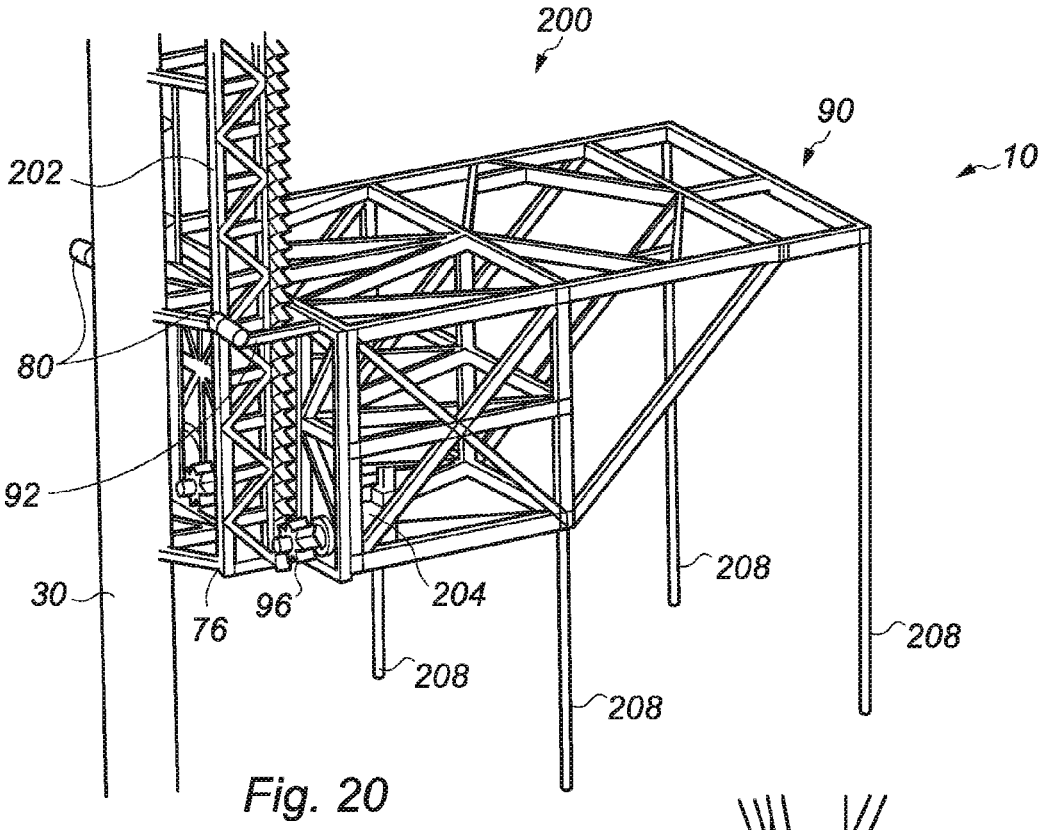
FIG. 20 is a perspective view of an embodiment of the raising framework of the invention.

FIG. 20 is a perspective view of an embodiment of a raising framework 90, as described previously with reference to FIGS. 4 to 6.

From FIG. 20, it can be seen that the guide rails 62 comprise a central bar portion 72 having a smooth front surface (not visible) that faces away from the support strut 30. The guide rails 62 are mounted to a lattice-type support framework 200 that is affixed to the support strut 30. The lattice-type framework 200 comprises a vertical rail 202 having a smooth rear surface 76 that faces towards the support strut 30, in use. The front and rear 76 surfaces provide rolling surfaces for respective, vertically spaced-apart sets of rollers 78, 80 to which a raising framework (not shown) is connected. The sides of each guide rail 62 are provided with toothed formations 82, which engage with the teeth of driving gears 96 to enable the raising framework 90 to be driven along the guide rails, either upwardly or downwardly, as required.

The raising framework 90 comprises a pair of arms 92 that extend behind the guide rails 202 at a relatively elevated position to support a set of rollers 80 that bear against the rear rolling surface 76 of the guide rails 202. The raising framework 90 additionally comprises another set of rollers (not visible) which are arranged to bear against front rolling surface of the guide rails 62. The toothed portions 82 of the guide rails 62 project sideward from the guide rails 62 and are engaged by motor-driven gears 96 to raise or lower the raising framework 90.

The raising framework 90 thus cooperates with the guide rails 62 to enable a payload, such as a support vessel, or crane, to be hoisted up the support strut 30 using set of motors 204 for driving the gears 96.

FIG. 20 additionally shows the raising framework 90 comprising four suspension lines 208, to which a boat hoist 210, as described with respect to FIG. 21 below, can be connected, in use.

Figure 21:
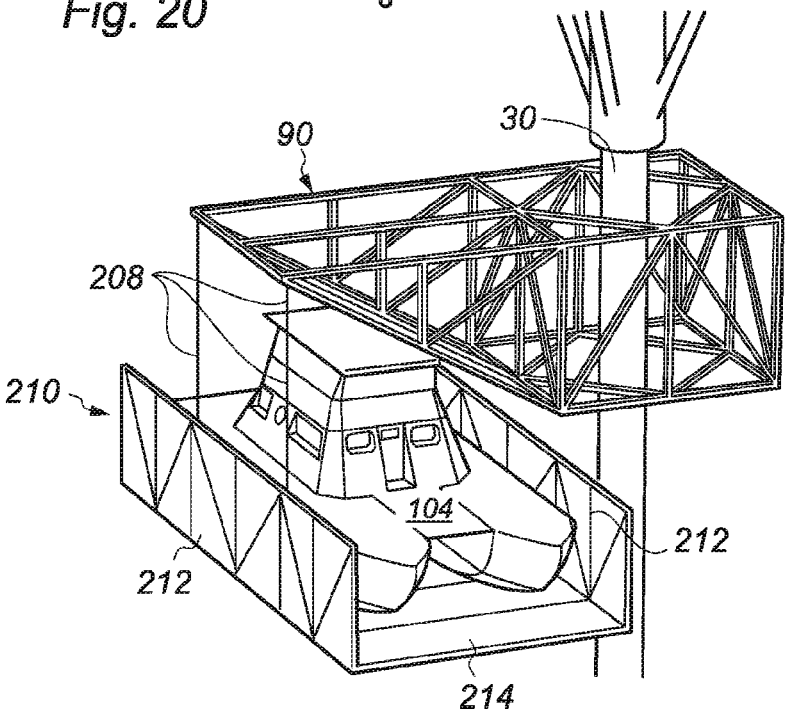
FIG. 21 is a perspective view of an embodiment of a boat lift suspended from the raising framework of FIG. 20.

In FIG. 21, the raising framework 90 comprises four suspension lines 208, which can be manufactured from steel rope, metal tubes or bars, and which hang below the raising framework 90. The boat hoist 210 comprises a pair of spaced-apart side walls 212, formed by a metal framework, and a base wall 214 manufactured also from a framework. The dimensions of the boat hoist 210 are selected to accommodate a support vessel 104, which can be driven into the framework when the boat hoist 210 is lowered to slightly below sea level.

The support vessel 104 can thus be located within the boat hoist 210, and raised out of the water by the raising framework 90, as previously described (in particular, with reference to FIG. 17 above). The provision of a dedicated boat hoist 210 is particularly advantageous because it obviates the need for crew members to attach and detach hoist lines 108, which can be difficult or dangerous in heavy seas.

In certain embodiments (not shown), a flexible and/or reticulated support sheet is affixed to the upper edges of the side walls 212 and hangs between them above the base 214 wall of the boat hoist 210. The provision of a flexible sheet or net enables the support vessel 108 to be retained securely by the boat hoist 210, i.e. by the sheet conforming to the shape of the underside of the hull. Such a configuration additionally reduces the likelihood of point-loading the hull of the support vessel 108 (for example, where the keel would otherwise engage the base wall struts).

Given that the boat hoist 210 is likely to be used in heavy seas, wave suppression means and/or fendering may be provided on the boat hoist 210, although not shown in the drawings. For example, inflatable tubes may be affixed to the upper edges of the side walls 212 of the boat hoist 210, thereby cushioning the support vessel 108 from impacts with the side walls 212, as well as providing shelter from the waves. Further, the inflatable tubes, or booms/pontoons may extend axially away from the boat hoist 210, and may provide a relatively protected entrance and exit to the boat hoist 210.

Figure 22:
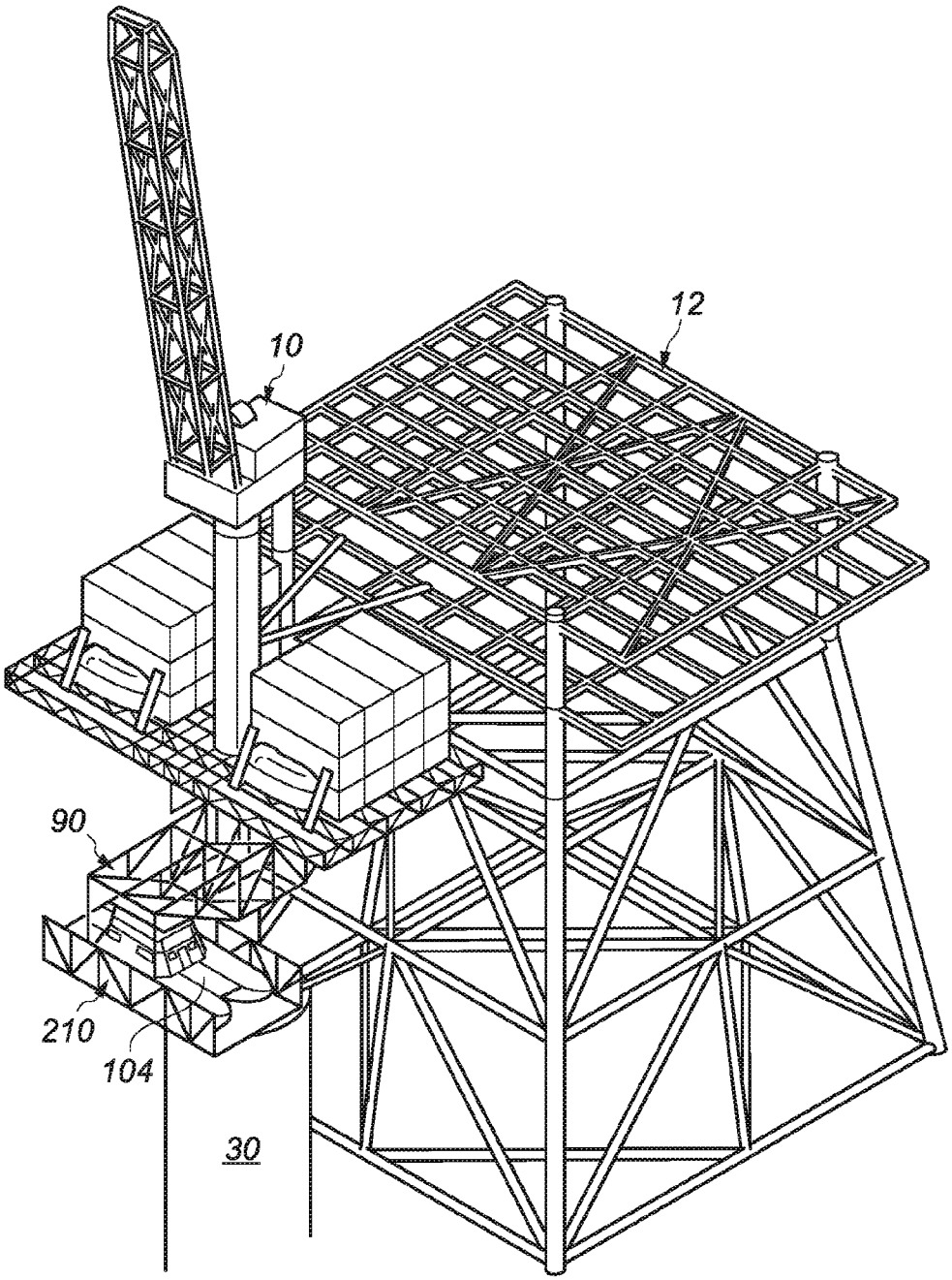
FIG. 22 is a perspective view of an embodiment of a support structure used in conjunction with an existing offshore platform.

FIG. 22 is a more detailed version of FIG. 1, albeit with a boat hoist 210 fitted thereto. It will be noted that the embodiment shown in FIG. 22 comprises an additional modification to the raising framework, which may be used in conjunction with any of the embodiments described herein. The modification is shown in particular with reference to FIGS. 24 and 25.

Figure 24:
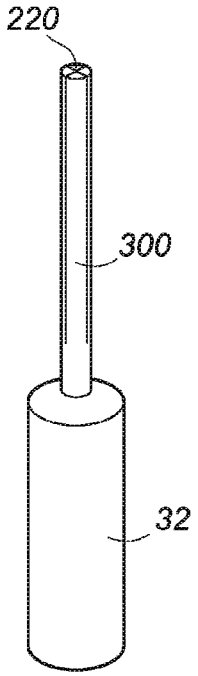
FIG. 24 is a simplified view of the support strut of the structure.
Figure 25:
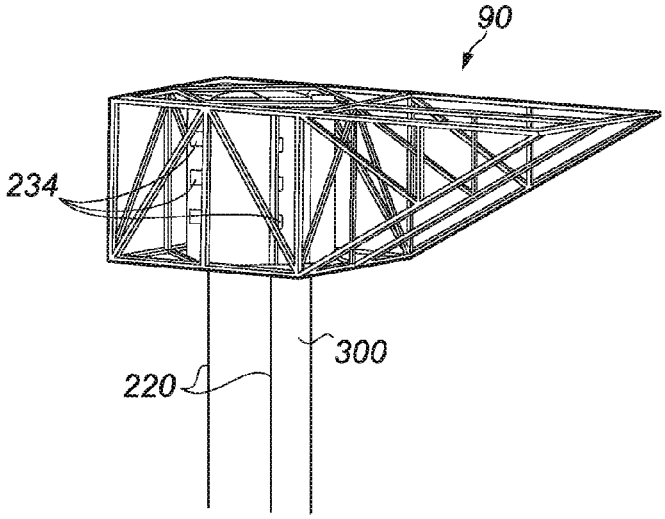
FIG. 25 illustrates how an alternative embodiment of the raising framework can be connected to the support strut of FIG. 24.

As can be seen in FIGS. 24 and 25, which are simplified views for clarity, the support strut 300 comprises four racks 220 in a cruciform arrangement thus dividing it into quadrants separated by the respective racks 220. The raising framework 90, as shown in FIG. 25, comprises four machine housings 234 which locate around the exterior of the support strut 300, and which support the gears and motors which engage with the racks 220. The raising framework 90 can be driven up or down the support strut 300 by motor- or engine-driven drive gears or wheels located within the machine housings 234, which cooperate between the support strut 300 and raising framework 90 to drive it up or down, as required.

The raising framework 90 is connected to the support strut 300, as previously described. The raising framework can likewise be used to hoist a support vessel (not shown) out of the water, a crane (not shown) to the top of the support strut 300, or other equipment and components, as previously described.

Notably, because the raising framework 90 of the embodiment shown in FIG. 25 surrounds the support strut 300, the upper struts can form the transfer rails for a payload, which can be slid sideways atop the support strut 300 when raised, and left there when the raising framework 90 lowers again.

Figure 23:
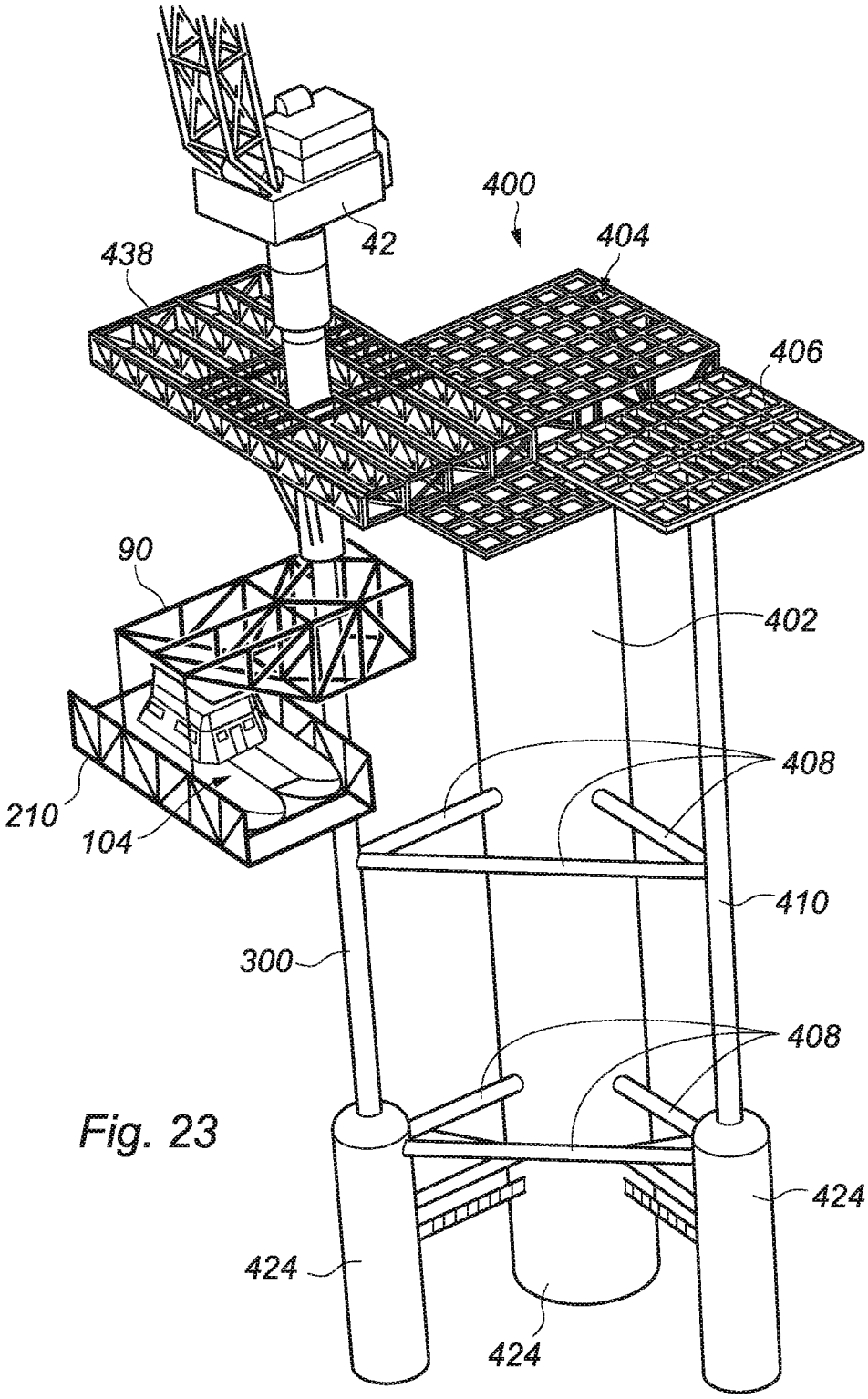
FIG. 23 is a perspective view of an embodiment of a support structure used in conjunction with a new build offshore platform.

It will be appreciated from the foregoing that although the invention is particularly suited to servicing operations for existing platforms, e.g. crane replacement etc., it is equally applicable to new installations, and an example of a new build offshore platform 400 and support structure 10 is shown in FIG. 23 of the drawings. The new build platform 400 comprises a main supporting monopole or support strut/structure 402 to which a main deck 404 is mounted. The operational equipment of the platform 400, e.g. a drilling rig (not shown) is located on the main deck 404.

A pair of additional support struts are provided: a first support strut 300, as described herein, which comprises a raising framework 90, crane 42, deck area 38 for temporary living accommodation etc.; and a second strut 410, which supports an additional deck 406. The additional deck 406 usefully provides an alternative location for certain items, e.g. equipment to support drilling operations etc., and also enables the support structure 10 of the invention to be truly "independent" of the main platform. The support struts 300, 410, 402 comprise foundations 424 at their lower ends, enabling them to be driven into a sea bed with relative ease. Further, because the support struts 300, 410, 402 are interconnected by cross-struts 408, a tripod-type structure is formed, which is inherently more stable than a mono-pile, and can be driven vertically into the sea bed by differentially varying the pressure in the foundations 424 during the driving process (as described in greater detail in UK Patent Application No: GB 12407991.7).

Figure 26:
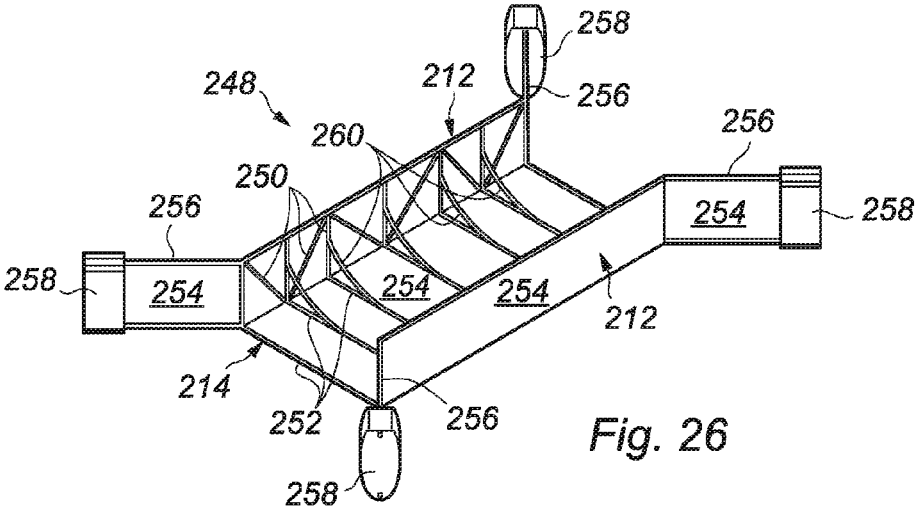
FIG. 26 is a perspective, schematic view, of a cradle for a boat hoist useable in conjunction with the invention.

Referring now to FIG. 26 of the drawings, a cradle 248 for the boat hoist 210 previously described comprises a steel support frame comprising two spaced-apart side walls 212 manufactured from steel sections 250 welded to form a rigid, triangulated structure. The side walls 212 are interconnected at their lower edges by a base wall 214 comprising steel sections 252 welded to, and spanning, the lower edges of the side walls.

The cradle 248 additionally comprises, extending outwardly at an angle, from each of its corners, a retractable boom 256. Each boom 256 comprises a pair of spaced-apart, horizontal metal tubes that terminate at their free ends, with a float 258. The floats 258 serve to stabilise the cradle 248 when floating in the water, or when lightly supported by the suspension lines (not shown). The angling of the booms 256 provides a tapered entrance and exit for the cradle 248 facilitating the entry and exit of a support vessel (not shown).

A flexible skin (e.g. of sheet plastics, or canvas), or a sheet metal skin 254, is provided on the exterior of the side walls 212 and booms 256, and optionally, below the base wall 214 of the cradle 248, to buffet the waves and to create a relatively calm "harbour" within the confines of the cradle 248.

Attached to the cradle 248, spanning the side walls, are a set of flexible slings 260, which engage with the contoured underside of the support vessel (not shown) as it is raised out of the water. As previously discussed, the slings could be replaced by a net or a flexible sheet to more evenly distribute the transference of the weight of the support vessel (not shown) to the cradle 248, thereby stabilising it and reducing the likelihood of hull punctures.

The invention is not restricted to the details of the foregoing embodiments, which are merely an example of an embodiment of the invention. For example, the foregoing description has focussed on the use of the support structure an alternative to an accommodation type jack-up. However, there are other types of jack-up, such as a drilling jack-up, to which the concept of the invention may offer an alternative solution. Specifically, the crane of the invention could be used to lift a drilling rig onto a platform that was designed to support such weight. This could be a particularly attractive concept to those energy companies looking to drill for shale gas offshore and utilise, where possible, their existing infrastructure.

The invention claimed is:

1. A support structure suitable for use as a support structure to an offshore platform, the support structure comprising a main support strut having a lower end and anchorable, in use, to a seabed and an upper portion arranged, in use, to extend above sea level to a height substantially equal to, or greater than, the height of the platform, the support strut comprising a guide rail extending upwardly from a level above the sea level to a top of the support strut for cooperating with a raising framework slideably mountable to the guide rail, and further comprising drive means cooperating between the raising framework and the guide rail for elevating the raising framework relative to a support rail, the support structure being characterised by: the support strut and raising framework each comprising tracks arranged to substantially align end-to-end when the raising framework is elevated to the top of the support strut, the tracks, when so aligned, forming a substantially continuous track for laterally transferring a payload from the raising framework to the top of the strut.

2. The support structure of claim 1, further comprising a boat hoist suspended from the raising framework by suspension lines manufactured from steel rope, metal tubes or bars, and hanging below the raising framework.

3. The support structure of claim 2, wherein the boat hoist additionally comprises any one or more of the group consisting of: wave suppression means, fendering the wave suppression means, and fendering, comprising an inflatable tube affixed to an upper edge of the side walls of the boat hoist, the inflatable tube extending axially away from the boat hoist to provide, in use, a relatively protected entrance and exit to the boat hoist.

4. The support structure of claim 2, wherein the boat hoist comprises a pair of spaced-apart side walls, formed by a metal framework, and a base wall manufactured also from a framework interconnecting lower edges of the side walls; and wherein the boat hoist additionally comprises a plurality of slings, or a flexible support sheet connected to upper edges of the side walls and is arranged, in use, to hang between the side walls above the base wall of the boat hoist.

5. The support structure of claim 4, wherein the flexible sheet is reticulated, and manufactured from steel rope.

6. The support structure as claimed in claim 1, wherein the tracks of the support strut project beyond an edge thereof and overlie upper ends of the guide rails.

7. The support structure as claimed in claim 1, wherein the respective tracks comprise complementarily chamfered ends.

8. The support structure as claimed in claim 1, wherein the guide rails extend downwardly from a point substantially level with an upper end of the support strut and extend, in use, upwardly from a point above sea level.

9. The support structure as claimed in claim 1, wherein the guide rails are rigidly connected to the support strut, at intervals, by connectors or by an intermediate structural framework.

10. The support structure as claimed in claim 1, wherein the guide rail comprises a central portion having a smooth front surface that faces away from the support strut, and wherein a smooth rear surface is provided that faces towards the support strut, in use, and wherein the front and rear surfaces provide respective rolling surfaces for vertically spaced-apart sets of rollers to which the raising framework is connected, an upper one of the rollers engaging the rear rolling surface and a lower one of the rollers engaging the front rolling surface and wherein the or each guide rail comprises toothed formations forming a rack located on either side of the central portion.

11. The support structure as claimed in claim 10, wherein the raising framework comprises a first arm that extends behind the guide rails at a relatively elevated position to support a first one of the rollers that bear against the rear rolling surface of the guide rail, and a second arm at a relatively lower position to which a second one of the rollers are connected that bear against front rolling surface of the guide rail.

12. The support structure as claimed in claim 1, wherein the raising framework is adapted to receive a crane, the support strut comprising a crane pedestal whose diameter is greater than the height of the support strut.

13. The support structure as claimed in claim 1, wherein the support strut comprises a hollow tube.

14. The support structure as claimed in claim 1, wherein the main support strut is buoyant in water and optionally further comprising a floatation collar that is slideable relative to the main support strut.

15. The support structure as claimed in claim 1, wherein a lower end of the support strut comprises an anchorage for positive engagement with the seabed, the anchorage comprising any one or more of the group comprising: a suction pile, a screw pile; and an anchorage connected to the support strut by a guy wire.

16. The support structure as claimed in claim 1, further comprising a connecting framework for connecting, in use, the support strut to the platform, the connecting framework comprising a part-circular collar for engagement with the support strut and a locating device adapted to clamp to the support strut, but which allows the support strut to cant between a tilted orientation and a substantially vertical orientation.

17. The support structure as claimed in claim 1, wherein the drive means comprises any one or more of the group consisting of: a motor-driven pulley system and a toothed section of the guide rail forming a rack arranged to cooperate with a motor-driven gear of the raising framework.

18. The support structure as claimed in claim 1, further comprising any one or more of the group consisting of: a crane; a fall-arrest device; a deck; an accommodation unit; a lifeboat; a power system for independently powering the support structure; a diesel generator; and a fuel tank.

19. A method of installing a support structure, comprising the steps of:

floating a support strut fitted with an anchorage to a platform;

up-ending the support strut to a substantially vertical orientation adjacent the platform and sinking the support strut until the anchorage engages a seabed;

anchoring a lower end of the support strut to the sea bed;

approaching the support strut at low tide with a support vessel carrying a raising framework and positioning the raising framework beneath lower ends of guide rails; as the tide rises, engaging lower ends of the guide rails with the raising framework and hoisting the raising framework at least partially up the guide rails.

20. The method as claimed in claim 19, further comprising any one or more of the steps consisting of: raising the raising framework carrying a crane to the top of the guide rails and laterally transferring the crane to a top of the support strut; and using the crane to transfer any one of more of the group comprising: a deck, living accommodation, equipment, life-support, and a connecting framework from the support vessel to the support structure; and hoisting the support vessel out of the water using the raising frame connected to the support vessel by one or more linkages or a boat hoist.

* * * * *